US008431322B2

(12) United States Patent
Maezawa

(10) Patent No.: US 8,431,322 B2
(45) Date of Patent: Apr. 30, 2013

(54) METHOD OF MANUFACTURING TONER

(75) Inventor: Nobuhiro Maezawa, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 155 days.

(21) Appl. No.: 12/985,625

(22) Filed: Jan. 6, 2011

(65) Prior Publication Data

US 2011/0183256 A1 Jul. 28, 2011

(30) Foreign Application Priority Data

Jan. 26, 2010 (JP) ..... P2010-014781

(51) Int. Cl.
*G03G 5/00* (2006.01)

(52) U.S. Cl.
USPC ..... 430/137.15; 430/109.4; 430/137.1

(58) Field of Classification Search ..... 430/108.1, 430/108.4, 109.1, 109.4, 137.1, 137.15, 137.18
See application file for complete search history.

(56) References Cited

U.S. PATENT DOCUMENTS 6,855,471 B2 * 2/2005 Katsuta et al. ..... 430/108.23
2007/0281235 A1 12/2007 Ono et al.
2008/0280218 A1 * 11/2008 Sabu et al. ..... 430/48
2009/0103950 A1 4/2009 Nakayama et al.
2009/0297973 A1 12/2009 Iwamoto et al.

FOREIGN PATENT DOCUMENTS

| | | |
|---|---|---|
| JP | 2009-098534 | 5/2009 |
| JP | 2009-098535 | 5/2009 |
| JP | 2009-103749 | 5/2009 |
| JP | 2009-175755 | 8/2009 |
| JP | 2009-258477 | 11/2009 |
| JP | 2009-288739 | 12/2009 |

* cited by examiner

*Primary Examiner* — Stewart Fraser
(74) *Attorney, Agent, or Firm* — Nixon & Vanderhye P.C.

(57) ABSTRACT

A method of manufacturing a toner is provided which is excellent in low temperature fixation property, whose fixable temperature width is large, as well as excellent in durability while giving consideration to the global environment conservation. The method of manufacturing a toner includes a step of producing a polyester resin by a reaction of dicarboxylic acid and diol, and a step of producing a toner base particle having the polyester resin and a colorant. The dicarboxylic acid is a biomass monomer having carboxyl groups introduced into ends of one, or two or more monocarboxylic acids selected from pimaric acid, isopimaric acid, and sandaracopimaric acid.

7 Claims, 1 Drawing Sheet

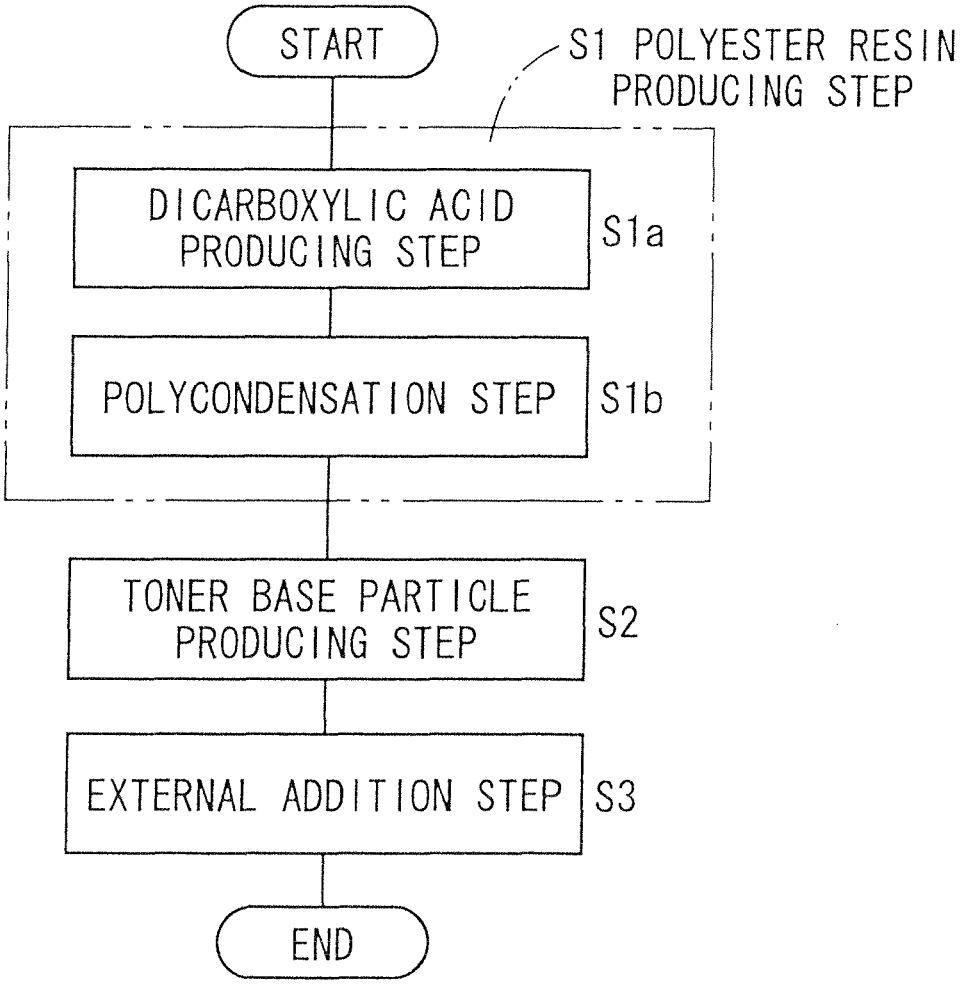
START
S1 POLYESTER RESIN PRODUCING STEP
DICARBOXYLIC ACID PRODUCING STEP
S1a
POLYCONDENSATION STEP
S1b
TONER BASE PARTICLE PRODUCING STEP
S2
EXTERNAL ADDITION STEP
S3
END

METHOD OF MANUFACTURING TONER

CROSS-REFERENCE TO RELATED APPLICATION

This application claims priority to Japanese Patent Application No. 2010-014781, which was filed on Jan. 26, 2010, the contents of which are incorporated herein by reference in its entirety.

BACKGROUND OF THE INVENTION

1. Field of the Invention

The present invention relates to a method of manufacturing a toner.

2. Description of the Related Art

A toner that visualizes a latent image is used for various image formation processes, and for example, is used for an electrophotographic image formation process.

In an image forming apparatus utilizing an image forming process of an electrophotographic system, in general, a desired image is formed on a medium by executing a charging step of uniformly charging a photosensitive layer on the surface of a photoreceptor drum which is a latent image bearing member; an exposure step of projecting signal light of an original image onto the surface of the photoreceptor drum in a charged state, thereby forming an electrostatic latent image; a development step of supplying an electrophotographic toner to the electrostatic latent image on the surface of the photoreceptor drum, thereby achieving visualization; a transfer step of transferring the toner image on the surface of the photoreceptor drum onto a medium such as paper or an OHP sheet; a fixing step of fixing the toner image onto the medium by heating, applying a pressure or the like; and a cleaning step of removing the toner or the like which remains on the surface of the photoreceptor drum after toner image transfer by a cleaning blade, thereby achieving cleaning. There may be the case where the transfer of the toner image onto the medium is carried out via an intermediate transfer medium.

A developer which is used for such an image forming apparatus includes a one-component developer containing only a toner as a major component and a two-component developer to be used upon mixing a toner and a carrier.

Also, the toner which is used for such a developer is manufactured by a polymerization method represented by, for example, a kneading pulverization method, a suspension polymerization method or an emulsion polymerization cohesion method. In the kneading pulverization method, the toner is manufactured by melt-kneading a toner raw material containing a binder resin and a colorant as major components and having optionally a release agent, a charge control agent, etc. added and mixed therein, cooling it for solidification and then pulverizing and classifying the solid.

Recently, much efforts are underway in various technical fields in terms of global environment conservation. Materials of many products are currently manufactured from oil, however, energy is needed at the time of manufacturing and incineration of these materials, and carbon dioxide is generated. It is much important as a global warming countermeasure to make efforts at reduction of such energy, carbon dioxide, and the like.

Energy saving as the global warming countermeasure has been considered from various angles, and in an electrophotographic field, reduction of fixed energy by lowering a fixed temperature of a toner transferred onto a medium such as paper or an OHP sheet is effective. On the other hand, further increase in speed of a copier and a fax is desired, and the toner is absolutely needed for having a low-melting point.

As a method of fixing a toner image which has been transferred onto a medium such as paper or an OHP sheet, there is often adopted a contact heating-type fixing system for heat melting a toner image by a heating roller or the like and fixing it upon applying a pressure. Fixability of the toner in this system can be evaluated by a fixable temperature width of from a lower limit temperature of fixation to a hot offset initiation temperature. The realization of a low melting point of the toner as referred to herein is to decrease the lower limit temperature of fixation, whereby realization of low-temperature fixation can be achieved.

As a binder resin for the toner, a resin having a cross-linked structure, a resin containing a high-molecular component and a low-molecular component, and the like, are used. For such binder resins, when a content of a cross-linked component or the high-molecular component is increased in order to improve high-temperature offset resistance, melt viscosity of the resin increases too much so that there is a possibility that low temperature fixation property of the toner becomes insufficient. On the other hand, when a content of the low-molecular component is increased in order to improve the low temperature fixation property, the melt viscosity of the resin decreases, however, elasticity of the toner is lowered, and the high-temperature offset resistance may be lowered as a result. Therefore, in order to satisfy the low-melting point and the offset resistance in a high temperature of the toner at the same time, design of the binder resin for the toner is particularly important.

Additionally, as a new effort toward reduction of carbon dioxide as the global warming countermeasure, enormous attention is focused on use of a plant-derived resource referred to as biomass. Carbon dioxide that generates at the time of burning of biomass is carbon dioxide in the atmosphere that is originally obtained by plant photosynthesis, and balance of carbon dioxide in the atmosphere is thus zero. Such a nature having no effect on increasing and decreasing of carbon dioxide in the atmosphere is referred to as carbon-neutral, and it is believed that use of carbon-neutral biomass does not increase a carbon dioxide amount in the atmosphere. Biomass materials that are manufactured from such biomass are referred to as names of a biomass polymer, biomass plastic, a nonpetroleum-based high-polymer material and the like, and such biomass materials are derived from a monomer as a raw material, referred to as a biomass monomer.

Such efforts are underway that biomass excellent in environment safety and which is a resource that works on suppression of increase of carbon dioxide is used also in the electrophotographic field.

For example, Japanese Unexamined Patent Publication JP-A 2009-98534 discloses a method of manufacturing a polyester resin for a toner that is obtained by condensation polymerization of an alcoholic component and a carboxylic acid component containing a reaction mixture with rosin derived from a pine and unsaturated carboxylic acid that are reacted each other.

However, there is a problem that the toner containing the polyester resin that is manufactured by the method disclosed in JP-A 2009-98534 is excellent in preservation stability, but has difficulty in increasing a degree of polymerization of the polyester resin due to a difference of reactivity between two carboxyl groups contained in a carboxylic acid component, and sufficient high-temperature offset resistance and durability are thus not able to be obtained.

SUMMARY OF THE INVENTION

An object of the invention is to provide a method of manufacturing a toner having excellent low temperature fixation property and high-temperature offset resistance, and large fixable temperature width as well as excellent durability while giving consideration to the global environment conservation.

The invention provides a method of manufacturing a toner, comprising:

a step of producing a polyester resin by a reaction of dicarboxylic acid and diol; and a step of producing a toner base particle comprising the polyester resin and a colorant, the dicarboxylic acid being a biomass monomer having carboxyl groups introduced into ends of one, or two or more monocarboxylic acids selected from pimaric acid, isopimaric acid, and sandaracopimaric acid.

According to the invention, the method of manufacturing a toner comprises a step of producing a polyester resin by a reaction of dicarboxylic acid and diol, and a step of producing a toner base particle having the polyester resin and a colorant. In the method of manufacturing a toner, the dicarboxylic acid is a biomass monomer having carboxyl groups introduced into ends of one, or two or more monocarboxylic acids selected from pimaric acid, isopimaric acid and sandaracopimaric acid. Therefore, a plant-derived compound is used as a raw material, thereby accelerating utilization of biomass, so that a method of manufacturing a toner giving consideration to the global environment conservation is provided. Furthermore, since the biomass monomer has carboxyl groups at both ends thereof, the reactivity with diol becomes high, and the polyester resin is able to be brought into a high polymer state, and as the result, the durability and the high-temperature offset resistance of the toner are possible to be improved so as to be capable of obtaining the toner having a large fixation range.

Further, in the invention, it is preferable that the biomass monomer is obtained through an aldehyde compound generated by oxidizing terminal alkenes of the monocarboxylic acid with ozone gas.

According to the invention, the biomass monomer is obtained through an aldehyde compound generated by oxidizing terminal alkenes of the monocarboxylic acid with ozone gas. Accordingly, the terminal alkenes whose reactivity is quite high are thus easily oxidized with ozone to become aldehyde so that the target dicarboxylic acid is able to be obtained efficiently without oxidizing other double bond parts. As the result, the polyester resin is able to be brought into a high polymer state efficiently, and a toner which is excellent in durability and high-temperature offset resistance is thus able to be obtained efficiently.

Further, in the invention, it is preferable that the biomass monomer is obtained by introducing the carboxyl group by oxidizing an aldehyde group of the aldehyde compound with sodium chlorite.

According to the invention, the biomass monomer is obtained by introducing the carboxyl group by oxidizing an aldehyde group of the aldehyde compound with sodium chlorite. Therefore, the reactivity of the introduced carboxyl group is allowed to be equivalent to the reactivity of the other carboxyl group. As a result, the reactivity with diol is improved to facilitate polymerization of the polyester resin, thus enabling to improve durability and fixation property of a toner.

Further, in the invention, it is preferable that weight average molecular weight of the polyester resin is 3000 or more and 30000 or less.

According to the invention, since weight average molecular weight of the polyester resin is 3000 or more and 30000 or less, a toner having a large non-offset region is able to be obtained.

Further, in the invention, it is preferable that a softening temperature of the polyester resin is 110° C. or higher and 140° C. or lower.

According to the invention, since a softening temperature of the polyester resin is 110° C. or higher and 140° C. or lower, a toner satisfying preservation stability and low temperature fixation property at the same time is able to be obtained.

Further, the invention provides a toner comprising:

a toner base particle having a polyester resin obtained by a reaction of dicarboxylic acid and diol and a colorant, the dicarboxylic acid being a biomass monomer having carboxyl groups introduced into ends of one, or two or more monocarboxylic acids selected from pimaric acid, isopimaric acid, and sandaracopimaric acid.

According to the invention, a toner includes a toner base particle having a polyester resin obtained by a reaction of dicarboxylic acid and diol and a colorant. The dicarboxylic acid is a biomass monomer having carboxyl groups introduced into ends of one, or two or more monocarboxylic acids selected from pimaric acid, isopimaric acid, and sandaracopimaric acid. Therefore, a toner having large fixation range which is excellent in durability and fixation property is provided.

BRIEF DESCRIPTION OF THE DRAWINGS

Other and further objects, features, and advantages of the invention will be more explicit from the following detailed description taken with reference to the drawings wherein:

FIG. 1 is a flowchart showing an example of procedures of a method of manufacturing a toner of the invention.

DETAILED DESCRIPTION

Now referring to the drawings, preferred embodiments of the invention are described below.

1. Method of Manufacturing Toner

FIG. 1 is a flowchart showing an example of procedures of a method of manufacturing a toner of the invention. The method of manufacturing a toner of the invention includes a polyester resin producing step S1, a toner base particle producing step S2, and an external addition step S3.

(1) Polyester Resin Producing Step S1

At the polyester resin producing step S1, a polyester resin which is a raw material of toner base particles is produced.

The polyester resin is excellent in transparency and capable of imparting to toner particles excellent powder fluidity, low-temperature fixation property and secondary color reproduction, etc., and therefore is suitable as a raw material for a color toner. Polyester is obtained by performing polycondensation of polybasic acid and polyhydric alcohol.

In the invention, as a polybasic acid, dicarboxylic acid is used. As the dicarboxylic acid, dicarboxylic acid obtained from plant-derived monocarboxylic acid is used. Using the plant-derived compound as a raw material enables to accelerate utilization of biomass.

Examples of the plant-derived monocarboxylic acid include a rosin-derived pine resin component such as abietic acid, dehydroabietic acid, neoabietic acid, palustric acid, pimaric acid, isopimaric acid, sandaracopimaric acid, and levopimaric acid. Among these monocarboxylic acids, it is preferable to use pimaric acid, isopimaric acid, and sandaracopimaric acid.

As a method of obtaining the dicarboxylic acid from these monocarboxylic acids, there is, for example, a method of generating an aldehyde compound by oxidizing terminal alkenes of the monocarboxylic acid with ozone or osmium tetroxide, and thereafter oxidizing an aldehyde group with sodium chlorite, sodium perchlorate, or Jones reagent. Thus obtained dicarboxylic acid is used as the biomass monomer to prepare polyester.

As polyhydric alcohol, one known as the monomer for polyester may be used, and examples thereof include aliphatic polyhydric alcohols such as ethylene glycol, propylene glycol, 1,3-propanediol, 1,4-butanediol, hexanediol, neopentyl glycol or glycerin; alicyclic polyhydric alcohols such as cyclohexanediol, cyclohexanedimethanol or hydrogenated bisphenol A; and aromatic diols such as ethylene oxide adduct of bisphenol A or propylene oxide adduct of bisphenol A. The polyhydric alcohols may be used each alone, or two or more of them may be used in combination.

According to the common procedure, the polycondensation reaction of the dicarboxylic acid and the polyhydric alcohol is, for example, performed by bringing polybasic acid into contact with polyhydric alcohol in the presence of an organic solvent and a polycondensation catalyst, and finished when the acid value or the softening temperature of polyester to be generated reaches a predetermined value. Thereby polyester is able to be obtained. In some cases, the organic solvent may not be used.

Polyester resin is able to be used in the form of self-dispersible polyester which exerts self-dispersibility in water by combining a hydrophilic group such as carboxyl group, a sulfonate group, etc. with main chain and/or a side chain of polyester. Moreover, a resin which grafting of a polyester resin and an acrylic resin is performed may be used.

It is preferable that weight average molecular weight of the polyester resin is 3000 or more and 30000 or less. When the weight average molecular weight of the polyester resin is less than 3000, the resin has no elasticity and thus the high-temperature offset easily occurs, and in the case of exceeding 30000, the elasticity of the resin becomes too great to decrease fixation strength thereof. The weight average molecular weight of the polyester resin is 3000 or more and 30000 or less so that a toner having a large non-offset region is able to be obtained.

It is preferable that the softening temperature of the polyester resin is 100° C. or higher and 150° C. or lower, and more preferably 110° C. or higher and 140° C. or lower. When the softening temperature of the polyester resin is lower than 110° C., preservation stability of the toner is deteriorated, and in the case of exceeding 140° C., the low-temperature offset easily occurs. When the softening temperature falls within the range of 100° C. or higher and 150° C. or lower, it is possible to satisfy the preservation stability and the fixation property of the toner at the same time.

The above-described polyester resin producing step S1 using the biomass monomer includes a dicarboxylic acid producing step S1a and a polycondensation step S1b.

(1-1) Dycarboxylilc Acid Producing Step S1a

At the dycarboxylilc acid producing step S1a, a carboxyl group is newly introduced into plant-derived monocarboxylic acid to prepare dicarboxylic acid.

The terminal alkenes of monocarboxylic acid are oxidized with an oxidant such as ozone or osmium tetroxide to be converted into an aldehyde group. The aldehyde group is converted into carboxylic acid with an oxidant such as sodium chlorite, sodium perchlorate, or Jones reagent.

As the plant-derived monocarboxylic acid, pimaric acid, isopimaric acid, and sandaracopimaric acid are preferably used. Since these monocarboxylic acids have alkenes at their ends, the terminal alkenes having high reactivity are easily oxidized and other double bond parts in the monocarboxylic acid are not oxidized. Therefore, new carboxylic acid is introduced into the end of the monocarboxylic acid so that reactivity of the two carboxyl groups contained in the obtained dicarboxylic acid is almost equivalent, and thus the dicarboxylic acid whose reactivity with polyhydric alcohol is high is able to be obtained. The monocarboxylic acids may be used each alone, or two or more of them may be used in combination. When two or more of the monocarboxylic acids are used in combination, two or more of the monocarboxylic acids are premixed and oxidized at the same time so that the dicarboxylic acid is able to be obtained.

(1-2) Polycondensation Step S1b

At the polycondensation step S1b, the dicarboxylic acid prepared at the dicarboxylic acid producing step S1a and polyhydric alcohol are subjected to polycondensation to obtain a polyester resin. It is preferable that the polycondensation reaction of the dicarboxylic acid and the polyhydric alcohol is performed in the presence of an esterification catalyst. Dicarboxylic acid and polyhydric alcohol are reacted in the presence of the esterification catalyst, and thereafter the reactant is subjected to temperature rise and depressurization so that the softening temperature of the polyester resin is adjusted to a desired value. As the esterification catalyst, for example, a titanium compound and a tin (II) compound not containing Sn—C bond are included, and as the titanium compound, a titanium compound containing Ti—O bond is preferable, and the titanium compound containing an alkoxy group, an alkenyloxy group, or an acyloxy group whose total carbon number is 1 to 28 is further preferable. These compounds may be used each alone, or two or more thereof may be used in combination.

(2) Toner Base Particle Producing Step S2

At the toner base particle producing step S2, toner base particles containing the polyester resin produced at the polyester resin producing step S1 and a colorant are produced. A toner base particle producing method is able to be performed with a known method without particular limitation. Examples of the toner base particle producing method include dry methods such as a pulverization method, and wet methods such as a suspension polymerization method, an emulsion aggregation method, a dispersion polymerization method, a dissolution suspension method and a melting emulsion method. The method of producing the toner base particles using the pulverization method will be described below.

(Producing of Toner Base Particle with Pulverization Method)

In producing toner base particles with the pulverization method, a toner composition containing the polyester resin, the colorant and the other additives is subjected to dry mixing by means of a mixer, and thereafter the mixture is melt-kneaded by means of a kneader. The kneaded product obtained by the melt-kneading is cooled to be solidified, and the solidified product is pulverized by means of a pulverizing machine. Subsequently, the particle size adjustment such as classification, etc. is carried out as necessary, thereby obtaining the toner base particles.

Usable mixers include heretofore known mixers including, for example, Henschel-type mixing devices such as HENSCHELMIXER (trade name) manufactured by Mitsui Mining Co., Ltd., SUPERMIXER (trade name) manufactured by Kawata MFG Co., Ltd., and MECHANOMILL (trade name) manufactured by Okada Seiko Co., Ltd.; ANGMILL (trade name) manufactured by Hosokawa Micron Corporation; HYBRIDIZATION SYSTEM (trade name) manufactured by Nara Machinery Co., Ltd.; and COSMOSYSTEM (trade name) manufactured by Kawasaki Heavy Industries, Ltd.

Usable kneaders include heretofore known kneaders including, for example, commonly-used kneaders such as a twin-screw extruder, a three roll mill, and a laboplast mill. Specific examples of such kneaders include single or twin screw extruders such as TEM-100B (trade name) manufactured by Toshiba Machine Co., Ltd., PCM-65/87 and PCM-30, both of which are trade names and manufactured by Ikegai, Ltd., and open roll-type kneading machines such as KNEADEX (trade name) manufactured by Mitsui Mining Co., Ltd. Among them, the open roll-type kneading machines are preferable.

Examples of the pulverizing machine include a jet pulverizing machine that performs pulverization using ultrasonic jet air stream, and an impact pulverizing machine that performs pulverization by guiding a solidified material to a space formed between a rotor that is rotated at high speed and a stator (liner).

For the classification, a known classifying machine capable of removing excessively pulverized toner base particles by classification with a centrifugal force or classification with a wind force is usable and an example thereof includes a revolving type wind-force classifying machine (rotary type wind-force classifying machine).

As the colorant contained in the toner base particles, it is possible to use an organic dye, an organic pigment, an inorganic dye, and an inorganic pigment, which are commonly used in the electrophotographic field.

Examples of a black colorant include carbon black, copper oxide, manganese dioxide, aniline black, activated carbon, non-magnetic ferrite, magnetic ferrite, and magnetite.

Examples of a yellow colorant include yellow lead, zinc yellow, cadmium yellow, yellow iron oxide, mineral fast yellow, nickel titanium yellow, navel yellow, naphthol yellow S, hanza yellow G, hanza yellow 10G, benzidine yellow G, benzidine yellow GR, quinoline yellow lake, permanent yellow NCG, tartrazine lake, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 180, and Pigment Yellow 185.

Examples of an orange colorant include red lead yellow, molybdenum orange, permanent orange GTR, pyrazolone orange, vulcan orange, indanthrene brilliant orange RK, benzidine orange G, indanthrene brilliant orange GK, C.I. Pigment Orange 31, and C.I. Pigment Orange 43.

Examples of red colorant include red iron oxide, cadmium red, red lead oxide, mercury sulfide, cadmium, permanent red 4R, lysol red, pyrazolone red, watching red, calcium salt, lake red C, lake red D, brilliant carmine 6B, eosin lake, rhodamine lake B, alizarin lake, brilliant carmine 3B, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53: 1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, and C.I. Pigment Red 222.

Examples of a purple colorant include manganese purple, fast violet B, and methyl violet lake.

Examples of a blue colorant include Prussian blue, cobalt blue, alkali blue lake, Victoria blue lake, phthalocyanine blue, metal-free phthalocyanine blue, phthalocyanine blue-partial chlorination product, fast sky blue, indanthrene blue BC, C.I. Pigment Blue 15, C.I. Pigment Blue 15:2, C.I. Pigment Blue 15:3, C.I. Pigment Blue 16, and C.I. Pigment Blue 60.

Examples of a green colorant include chromium green, chromium oxide, pigment green B, malachite green lake, final yellow green G, and C.I. Pigment Green 7.

Examples of a white colorant include zinc oxide, titanium oxide, antimony white, and zinc sulfide.

The colorants may be used each alone, or two or more of different colors thereof may be used in combination. Further, two or more of the colorants with the same color may be used in combination.

Colorant concentration in the toner base particle, in the case of the black colorant, is preferably 5% by weight or more and 12% by weight or less, and further preferably 6% by weight or more and 8% by weight or less. In the case of the colorant other than black, 3% by weight or more and 8% by weight or less is preferable, and 4% by weight or more and 6% by weight or less is further preferable.

The colorant may be used in form of a masterbatch to be dispersed into the polyester resin uniformly. Furthermore, two or more of the colorants may be used in form of composite particles. The composite particles, for example, are able to be manufactured by adding an appropriate amount of water, lower alcohol, etc. into two or more colorants, granulated by a common granulator such a high-speed mill to be dried. The masterbatch or the composite particles are mixed into a toner composition at the time of dry mixing.

The toner base particle may contain magnetic powder, a release agent, a charge control agent or the like as well as the polyester resin and the colorants.

Examples of the magnetic powder include magnetite, γ-hematite, and various kinds of ferrites.

As the release agent, it is possible to use ingredients which are customarily used in the relevant field, including, for example, petroleum wax such as paraffin wax and derivatives thereof, and microcrystalline wax and derivatives thereof; hydrocarbon-based synthetic wax such as Fischer-Tropsch wax and derivatives thereof, polyolefin wax (e.g. polyethylene wax and polypropylene wax) and derivatives thereof, low-molecular-weight polypropylene wax and derivatives thereof, and polyolefinic polymer wax (low-molecular-weight polyethylene wax, etc.) and derivatives thereof; vegetable wax such as carnauba wax and derivatives thereof, rice wax and derivatives thereof, candelilla wax and derivatives thereof, and haze wax; animal wax such as bees wax and spermaceti wax; fat and oil-based synthetic wax such as fatty acid amides and phenolic fatty acid esters; long-chain carboxylic acids and derivatives thereof; long-chain alcohols and derivatives thereof; silicone polymers; and higher fatty acids. Examples of the derivatives include oxides, block copolymers of a vinylic monomer and wax, and graft-modified derivatives of a vinylic monomer and wax. A usage of the wax may be appropriately selected from a wide range without particularly limitation. An additive amount of the release agent is preferably 1 to 10 parts by weight based on 100 parts by weight of the toner base particles.

For the charge control agent, charge control agents commonly used in this field for controlling a positive charge and a negative charge are usable.

Examples of the charge control agent for controlling a positive charge include a basic dye, a quaternary ammonium salt, a quaternary phosphonium salt, aminopyrine, a pyrimidine compound, a polynuclear polyamino compound, aminosilane, a nigrosine dye and a derivative thereof, a triphenylmethane derivative, a guanidine salt and an amidin salt.

Examples of the charge control agent for controlling a negative charge include an oil-soluble dye such as oil black and spirone black, a metal-containing azo compound, an azo complex dye, a naphthene acid metal salt, a metal complex or metal salt (the metal is chrome, zinc, zirconium or the like) of a salicylic acid or of a derivative thereof, a boron compound, a fatty acid soap, a long-chain alkylcarboxylic acid salt and a resin acid soap. The charge control agents may be used each alone, or optionally two or more of them may be used in combination. Although the amount of the charge control agent to be used is not particularly limited and can be properly selected from a wide range, 0.01 part by weight to 5 parts by weight is preferably used based on 100 parts by weight of the toner base particles.

The toner base particles obtained at the toner base particle producing step S2 are preferable to have the volume average particle size of 4 μm or more and 8 μm or less. When the volume average particle size is 4 μm or more and 8 μm or less, a high-definition image is able to be formed stably over a long period of time. Furthermore, by making the toner base particles smaller in particle size within the range, high image concentration is able to be obtained even when the attachment amount is small, and thus an effect possible to delete the toner consumption occurs. When the volume average particle size of the toner base particle is 4 μm or less, the particle size of the toner base particles is small so that high-electrification and lowering of fluidity of the toner may be caused. When the toner is subjected to high-electrification and lowering of fluidity, the toner is not possible to be supplied to the photoreceptor stably, and there is a possibility of occurrence of background fogging and decrease in image concentration. When the volume average particle size of the toner base particle exceeds 8 μm, the particle size of the toner base particle is large and a layer thickness of the formed image is large, and thus resulting in an image having remarkable granularity, and it is impossible to obtain a high-definition image. Furthermore, as the particle size of the toner base particle increases, specific surface area decreases, and thus the toner charging amount becomes small. When the toner charging amount becomes small, the toner is not supplied to the photoreceptor stably, thus causing a possibility of occurrence of pollution inside the apparatus caused by the toner scattering.

(3) External Addition Step S3

At the external addition step S3, an external additive is added to the toner base particles produced at the toner base particle producing step S2. As the external additive, one heretofore known is usable, and examples thereof include silica and titanium oxide. Furthermore, these are preferably subjected to surface treatment with a silicone resin, a silane coupling agent or the like. A usage of the external additive is preferably 1 to 10 parts by weight based on 100 parts by weight of the toner base particles.

2. Toner

The toner according to an embodiment of the invention is manufactured by the method of manufacturing the toner according to the above-described embodiment. The toner that is obtained by the above-described method of manufacturing the toner contains a polymerized polyester resin, and thus is excellent in durability and fixation property.

EXAMPLES

Descriptions will be made concretely for the invention giving examples and comparative examples below. The invention is particularly not limited to the examples without departing from the gist of the invention.

The following measurement was made for weight average molecular weight and a softening temperature of a polyester resin, and a volume average particle size and a coefficient of variation of a toner in Examples and Comparative Examples.

[Weight Average Molecular Weight (Mw) of Polyester Resin]

A specimen was dissolved in tetrahydrofuran (THF) so as to be 0.25% by weight, which specimen solution of 200 pL was analyzed by a GPC apparatus (trade name: HLC-8220GPC, manufactured by Tosoh Corporation) to obtain a molecular weight distribution curve at a temperature of 40° C. Weight average molecular weight Mw was obtained from the obtained molecular weight distribution curve. A molecular weight calibration curve was made using standard polystyrene.

[Softening Temperature (Tm) of Polyester Resin]

A flow characteristic evaluating device (trade name: Flowtester CFT-500C, manufactured by Shimadzu Corporation) was used to heat 1 g of a specimen at a temperature rising rate of 6° C. per minute, and a load of 10 kgf/cm$^2$ (0.98 MPa) was imparted thereto, then a temperature in a case where half the amount of the specimen is spilled out of a die (nozzle diameter of 1 mm and length thereof of 1 mm) was obtained to serve as a softening temperature (Tm).

[Volume Average Particle Size and Coefficient of Variation (CV) of Toner]

To 50 ml of an electrolytic solution (trade name: ISOTON-II, manufactured by Beckman Coulter Inc.), 20 mg of a specimen and 1 ml of sodium alkylether sulfate ester (dispersant, manufactured by Kishida Chemical Co., Ltd.) were added, and a thus-obtained admixture was subjected to dispersion processing of an ultrasonic distributor (trade name: UH-50, manufactured by SMT Co., Ltd.) for 3 minutes, which served as a specimen for measurement. As to this specimen for measurement, a particle size distribution measuring apparatus (trade name: Multisizer 3, manufactured by Beckman Coulter Inc.) was used to perform measurement under conditions of an aperture diameter: 20 μm, and the number of particles to be measured: 50,000 counts, and from the volume particle size distribution of the specimen particles, the volume average particle size and a standard deviation in the volume particle size distribution were obtained. A coefficient of variation (CV value, %) was calculated based on the following formula.

$$CV\text{ value }(\%)=(\text{Standard deviation in the volume particle size distribution}/\text{Volume average particle size})\times 100$$

Example 1

[Polyester Resin Producing Step S1]

To 300 g of pimaric acid, 1 L of methanol and 200 mL of toluene were added, and such a solution, while stirring at −10° C., was subjected to bubbling of ozone gas at a flow amount of 1 L/minute for 3 hours from an ozonizer (FAS, manufactured by Roki Techno Co., Ltd.). Then, after being subjected to bubbling of nitrogen gas at a flow amount of 2 L/minute for 20 minutes at −10° C., 100 g of powdered zinc (manufactured by Kishida Chemical Co., Ltd.) was added to the solution at −20° C., and 200 mL of acetic acid (manufactured by Kishida Chemical Co., Ltd.) was dropped to the solution at 10 mL/minute at −20° C. Further, 1 L of a saturated sodium bicarbonate solution was dropped to the solution at 100 mL/minute at 0° C. Thereafter, ethyl acetate was extracted therefrom, and the extracted product was salted out and concentrated, then 257 g of an aldehyde compound was obtained.

To the obtained aldehyde compound of 257 g, 1 L of t-butanol, 50 g of sodium hydrogenphosphate (manufactured by Kishida Chemical Co., Ltd.) and 50 g of 2-methyl-2-butane (manufactured by Kishida Chemical Co., Ltd.) were added. At 0° C., 100 mL of a 40%-sodium chlorite solution (manufactured by Kishida Chemical Co., Ltd.) was added to the solution to be stirred for 1 hour at 25° C. Thereafter, at 0° C., 1 L of the saturated sodium bicarbonate solution was dropped to the solution at 100 mL/minute, followed by extraction of ethyl acetate, and the extracted product was salted out and concentrated, then 250 g of dicarboxylic acid was obtained.

<Polycondensation Step S1b>

The above-described steps were performed several times to melt the produced dicarboxylic acid of 4 kg at 170° C., to which melted product, 0.57 kg of 1,3-propanediol and 1.65 kg of bisphenol A were added as polyhydric alcohols, and titanium diisopropylate bis triethanolaminate was added thereto as an esterification catalyst, followed by a reaction for 2 hours at 165° C. under a nitrogen atmosphere in a four-necked flask whose volume is 10 liter. At that time, the four-necked flask was equipped with a fractionating tube (through which hot water passes at 98° C.) at which upper part having a reflux cooling tube (through which water at 25° C. passes), a nitrogen introduction tube, a dewatering conduit, an agitator and a mercury thermometer. Subsequently, the temperature of the reacted product was raised to 200° C. for 4 hours, followed by depressurization to 50 kPa, and the reaction was performed until reaching a desired softening temperature, then a polyester resin a (Mw: 20000, Tm: 120° C.) was obtained.

| [Toner base particle producing step S2] | |
|---|---|
| Polyester resin a (Mw: 20000, Tm: 120° C.) | 85 parts by weight |
| Colorant (a copper phthalocyanine pigment kneaded product preliminarily kneaded and dispersed at 40% by weight into an amorphous polyester resin, pigment concentration: 4%) | 10 parts by weight |
| Release agent (polyethylene wax, trade name: PW-600, manufactured by Baker Petrolite, melting point: 87° C.) | 3 parts by weight |
| Charge control agent (trade name: Copy Charge N4P VP 2481, manufactured by Clariant (Japan) K.K.) | 2 parts by weight |

The above raw materials were pre-mixed by a Henschel mixer (trade name: FM20C, manufactured by Mitsui Mining Co., Ltd.) for 10 minutes, and a raw material mixture (THF insoluble component: 15.8%) was obtained. The mixture was melt-kneaded (set temperature: 140° C., supply amount: 5 Kg/H) with a biaxial extruder (trade name: PCM-37, manufactured by Ikegai, Ltd.) and the melt-kneaded product (THF insoluble component: 21.8%) was obtained.

The resultant melt-kneaded product, after being cooled to a room temperature and solidified, was coarsely pulverized by means of a cutter mill (trade name: VM-16, manufactured by Orient Co., Ltd), and the coarsely pulverized product was finely pulverized by means of a counter jet mill (trade name: AFC, manufactured by Hosokawa Micron Corporation), then further classified with a rotary-type classifying machine (trade name: TSP separator, manufactured by Hosokawa Micron Co., Ltd.) to obtain toner base particles.

[External Addition Step S3]

To 100 parts by weight of the obtained toner base particles, 1.2 parts by weight of a hydrophobic silica fine powder particle A (surface treatment with a silane coupling agent and a dimethyl silicone oil, BET specific surface area: 140 $m^2/g$), 0.8 part by weight of a hydrophobic silica fine powder particle B (surface treatment with a silane coupling agent, BET specific surface area: 30 $m^2/g$) and 0.5 part by weight of titanium oxide (BET specific surface area: 130 $m^2/g$) were added, followed by mixing with a Henschel mixer (trade name: FM mixer, manufactured by Mitsui Mining Co., Ltd.), and the toner of Example 1 (volume average particle size: 7.0 μm, CV: 25%) was obtained.

Example 2

At the polyester resin producing step S1, a polyester resin b (Mw: 20500, Tm: 120° C.) was obtained in the same manner as Example 1 except that isopimaric acid was used in place of pimaric acid. At the toner base particle producing step S2, the toner of Example 2 (volume average particle size: 6.9 μm, CV: 26%) was obtained in the same manner as Example 1 except that the polyester resin b was used in place of the polyester resin a.

Example 3

At the polyester resin producing step S1, a polyester resin c (Mw: 19500, Tm: 120° C.) was obtained in the same manner as Example 1 except that sandaracopimaric acid was used in place of pimaric acid. At the toner base particle producing step S2, the toner of Example 3 (volume average particle size: 7.0 μm, CV: 26%) was obtained in the same manner as Example 1 except that the polyester resin c was used in place of the polyester resin a.

Example 4

At the polyester resin producing step S1, a polyester resin d (Mw: 20000, Tm: 120° C.) was obtained in the same manner as Example 1 except that the mixture of pimaric acid, isopimaric acid and sandaracopimaric acid (mixture molar ratio=1:1:1) was used in place of pimaric acid. At the toner base particle producing step S2, the toner of Example 4 (volume average particle size: 7.0 μm, CV: 25%) was obtained in the same manner as Example 1 except that the polyester resin d was used in place of the polyester resin a.

Example 5

At the polyester resin producing step S1, a polyester resin e (Mw: 3000, Tm: 115° C.) was obtained in the same manner as Example 1 except that an additive amount of 1,3-propanediol was 0.71 kg and an additive amount of bisphenol A was 1.07 kg. At the toner base particle producing step S2, the toner of Example 5 (volume average particle size: 7.1 μm, CV: 25%) was obtained in the same manner as Example 1 except that the polyester resin e was used in place of the polyester resin a.

Example 6

At the polyester resin producing step S1, a polyester resin f (Mw: 2500, Tm: 113° C.) was obtained in the same manner as Example 1 except that an additive amount of 1,3-propanediol was 0.77 kg and an additive amount of bisphenol A was 0.83 kg. At the toner base particle producing step S2, the toner of Example 6 (volume average particle size: 7.0 μm, CV: 24%) was obtained in the same manner as Example 1 except that the polyester resin f was used in place of the polyester resin a.

Example 7

At the polyester resin producing step S1, a polyester resin g (Mw: 30000, Tm: 125° C.) was obtained in the same manner as Example 1 except that an additive amount of 1,3-propanediol was 0.27 kg and an additive amount of bisphenol A was 2.98 kg. At the toner base particle producing step S2, the toner of Example 7 (volume average particle size: 6.9 μm, CV: 24%) was obtained in the same manner as Example 1 except that the polyester resin g was used in place of the polyester resin a.

Example 8

At the polyester resin producing step S1, a polyester resin h (Mw: 30500, Tm: 128° C.) was obtained in the same manner as Example 1 except that an additive amount of 1,3-propanediol was 0.20 kg and an additive amount of bisphenol A was 3.30 kg. At the toner base particle producing step S2, the toner of Example 8 (volume average particle size: 6.9 μm, CV: 26%) was obtained in the same manner as Example 1 except that the polyester resin h was used in place of the polyester resin a.

Example 9

At the polyester resin producing step S1, a polyester resin i (Mw: 11000, Tm: 110° C.) was obtained in the same manner as Example 1 except that an additive amount of 1,3-propanediol was 0.86 kg and an additive amount of bisphenol A was 0.42 kg. At the toner base particle producing step S2, the toner of Example 9 (volume average particle size: 7.1 μm, CV: 25%) was obtained in the same manner as Example 1 except that the polyester resin i was used in place of the polyester resin a.

Example 10

At the polyester resin producing step S1, a polyester resin j (Mw: 9000, Tm: 107° C.) was obtained in the same manner as Example 1 except that an additive amount of 1,3-propanediol was 1.00 kg and bisphenol A was not added. At the toner base particle producing step S2, the toner of Example 10 (volume average particle size: 7.0 μm, CV: 25%) was obtained in the same manner as Example 1 except that the polyester resin j was used in place of the polyester resin a.

Example 11

At the polyester resin producing step S1, a polyester resin k (Mw: 24000, Tm: 140° C.) was obtained in the same manner as Example 1 except that an additive amount of 1,3-propanediol was 0.08 kg and an additive amount of bisphenol A was 3.78 kg. At the toner base particle producing step S2, the toner of Example 11 (volume average particle size: 7.0 μm, CV: 24%) was obtained in the same manner as Example 1 except that the polyester resin k was used in place of the polyester resin a.

Example 12

At the polyester resin producing step S1, a polyester resin 1 (Mw: 25500, Tm: 143° C.) was obtained in the same manner as Example 1 except that an additive amount of 1,3-propanediol was 0.04 kg and an additive amount of bisphenol A was 3.94 kg. At the toner base particle producing step S2, the toner of Example 12 (volume average particle size: 6.8 μm, CV: 26%) was obtained in the same manner as Example 1 except that the polyester resin 1 was used in place of the polyester resin a.

Example 13

At the polyester resin producing step S1, a polyester resin m (Mw: 20000, Tm: 120° C.) was obtained in the same manner as Example 1 except that 0.68 kg of 1,4-butanediol was used in place of 1,3-propanediol and bisphenol A. At the toner base particle producing step S2, the toner of Example 13 (volume average particle size: 7.1 μm, CV: 26%) was obtained in the same manner as Example 1 except that the polyester resin m was used in place of the polyester resin a.

Example 14

At the polyester resin producing step S1, a polyester resin n (Mw: 20000, Tm: 120° C.) was obtained in the same manner as Example 1 except that the mixture of pimaric acid and isopimaric acid (mixture molar ratio=1:1) was used in place of pimaric acid. At the toner base particle producing step S2, the toner of Example 14 (volume average particle size: 6.9 μm, CV: 25%) was obtained in the same manner as Example 1 except that the polyester resin n was used in place of the polyester resin a.

Example 15

At the polyester resin producing step S1, a polyester resin o (Mw: 20000, Tm: 120° C.) was obtained in the same manner as Example 1 except that the mixture of pimaric acid and sandaracopimaric acid (mixture molar ratio=1:1) was used in place of pimaric acid. At the toner base particle producing step S2, the toner of Example 15 (volume average particle size: 6.9 μm, CV: 25%) was obtained in the same manner as Example 1 except that the polyester resin o was used in place of the polyester resin a.

Example 16

At the polyester resin producing step S1, a polyester resin p (Mw: 20000, Tm: 120° C.) was obtained in the same manner as Example 1 except that the mixture of isopimaric acid and sandaracopimaric acid (mixture molar ratio=1:1) was used in place of pimaric acid. At the toner base particle producing step S2, the toner of Example 16 (volume average particle size: 7.2 μm, CV: 24%) was obtained in the same manner as Example 1 except that the polyester resin p was used in place of the polyester resin a.

Example 17

At the polyester resin producing step S1, the reaction for generating an aldehyde compound from pimaric acid was performed as follows.

To 450 g of sodium periodate (manufactured by Kishida Chemical Co., Ltd.), a 1,4-dioxane 200-mL solution containing 5 g of osmium tetroxide (manufactured by Kishida Chemical Co., Ltd.) was added, and 0.8 L of 1,4-dioxane and 200 mL of water were further added. To such a solution, while stirring at −10° C., 100 mL of 2,6-lutidine was added, then 300 g of pimaric acid was added, followed by stirring for 12 hours at 40° C. Additionally, 1 L of a saturated ammonium chloride solution was dropped to the solution at 100 mL/minute at 0° C., followed by extraction of ethyl acetate, and the extracted product was salted out and concentrated to obtain 217 g of an aldehyde compound.

Dicarboxylic acid was obtained in the same manner as Example 1 except that an aldehyde compound obtained in this manner was used, and a polyester resin q (Mw: 20000, Tm: 120° C.) was further obtained using the dicarboxylic acid. At the toner base particle producing step S2, the toner of Example 17 (volume average particle size: 7.0 μm, CV: 25%) was obtained in the same manner as Example 1 except that the polyester resin q was used in place of the polyester resin a.

Example 18

At the polyester resin producing step S1, the reaction for obtaining dicaboxylic acid from an aldehyde compound generated from pimaric acid was performed as follows.

To 210 g of an aldehyde compound, 1.5 L of acetone was added, and to a solution thereof, 100 mL of concentrated sulfuric acid solution (Jones reagent) of chromic acid (VI) was added at 0° C. to be stirred for 1 hour. Then, at 0° C., 1.5 L of a saturated sodium bicarbonate solution was dropped to the solution at 100 mL/minute, followed by extraction of ethyl acetate, and the extracted product was salted out and concentrated to obtain 211 g of dicarboxylic acid.

A polyester resin r (Mw: 20000, Tm: 120° C.) was obtained in the same manner as Example 1 except that dicarboxylic acid obtained in this manner was used. At the toner base particle producing step S2, the toner of Example 18 (volume average particle size: 6.8 μm, CV: 27%) was obtained in the same manner as Example 1 except that the polyester resin r was used in place of the polyester resin a.

Example 19

At the polyester resin producing step S1, a polyester resin s (Mw: 3000, Tm: 105° C.) was obtained in the same manner as Example 1 except that polymerization reaction time of dicarboxylic acid, 1,3-propanediol and bisphenol A was set to 40 minutes. At the toner base particle producing step S2, the toner of Example 19 (volume average particle size: 6.9 μm, CV: 25%) was obtained in the same manner as Example 1 except that the polyester resin s was used in place of the polyester resin a.

Comparative Example 1

At the polyester resin producing step S1, a polyester resin t (Mw: 3000, Tm: 112° C.) was obtained in the same manner as Example 1 except that dicarboxylic acid was not produced and pimaric acid was used in place of dicarboxylic acid. At the toner base particle producing step S2, the toner of Comparative Example 1 (volume average particle size: 7.0 μm, CV: 25%) was obtained in the same manner as Example 1 except that the polyester resin t was used in place of the polyester resin a.

Comparative Example 2

At the polyester resin producing step S1, according to the method described in Example 1 described in JP-A 2009-98534 (refer to paragraphs [0068] and [0069]), a polyester resin u (Mw: 3500, Tm: 115° C.) was produced. At the toner base particle producing step S2, the toner of Comparative Example 2 (volume average particle size: 7.0 μm, CV: 25%) was obtained in the same manner as Example 1 except that the polyester resin u was used in place of the polyester resin a.

Comparative Example 3

At the polyester resin producing step S1, a polyester resin v (Mw: 4500, Tm: 113° C.) was obtained in the same manner as Example 1 except that abietic acid was used in place of pimaric acid. At the toner base particle producing step S2, the toner of Comparative Example 3 (volume average particle size: 7.0 μm, CV: 25%) was obtained in the same manner as Example 1 except that the polyester resin v was used in place of the polyester resin a.

The following evaluation was performed concerning the obtained toners of Examples 1 to 19 and Comparative Examples 1 to 3.

[Preservation Stability]

A toner of 100 g was sealed in a plastic container, followed by leaving at 50° C. for 48 hours, thereafter the toner was taken out from the container to vibrate for 1 minute at 60 Hz by a 200-mesh vibrating sieving machine. The weight of the toner remained on the sieve was measured, and the rate (%) relative to the total weight of the toner was obtained as the remaining amount, then preservation stability was evaluated based on the following standards.

Good (Favorable): The remaining amount of the toner is less than 1%.

Not bad (No problem with practical use): The remaining amount of the toner is 1% or more and less than 3%.

Poor (No good): The remaining amount of the toner is 3% or more.

[Fixation Property]

Each toner and a ferrite core carrier whose volume average particle size is 45 μm were mixed for 20 minutes with a V-mixer (trade name: V-5, manufactured by Tokuju Corporation) so that a coating rate of each toner relative to the carrier was 60%, thereby producing a two-component developer containing each toner.

Each of the obtained two-component developers filled the remodeled color multi-functional peripheral (trade name: MX-2700, manufactured by Sharp Corporation) to produce an unfixed image. A sample image including a rectangular solid image section (20 mm long and 50 mm wide) was adjusted so that an attachment amount of a toner to recording paper (trade name: PPC paper SF-4AM3, manufactured by Sharp Corporation) in unfixed conditions at the solid image section becomes 0.5 mg/cm$^2$. The produced unfixed image was fixed from 100° C. to 200° C. at intervals of 10° C. (processing speed: 124 mm/sec) with use of an external fuser including a fixing section of the above-described color multi-functional peripheral, and presence or absence of offset on the surface of test paper (A4 size, 52 g/m$^2$ paper) was visually checked. A temperature range in which neither low-temperature offset nor high-temperature offset appears served as a non-offset region, and a temperature difference between a lower limit temperature without occurrence of the low-temperature offset and an upper limit temperature without occurrence of the high-temperature offset served as a temperature width, then the fixation property was evaluated based on the following standards.

Good (Favorable): The temperature width of the non-offset region is 60° C. or more.

Not bad (No problem with practical use): The temperature width of the non-offset region is 40° C. or more and less than 60° C.

Poor (No good): The temperature width of the non-offset region is less than 40° C.

[Durability]

Printing processing was continuously performed onto 10000 sheets of paper (A4 size), and durability was evaluated based on an aggregation state of a developer. A coverage of an image subjected to the printing processing onto each paper was set to 5%. Concerning aggregation of the developer, fluidity of the developer after performing the printing processing was measured to measure the presence or absence of aggregation. Note that, for fluidity measurement, a fluidity measurement device (trade name: vibration transfer fluidity measurement device, manufactured by ETOWASU K.K.) was used to measure the transfer time of the developer on test conditions where voltage is 60 V and the number of vibration is 137 Hz. At the time, the transfer time of the unused developer was less than 5 minutes. Durability was evaluated based on the following standards.

Good (Favorable): The transfer time is less than 5 minutes.

Not bad (No problem with practical use): The transfer time is 5 minutes or more and less than 10 minutes.

Poor (No good): The transfer time is 10 minutes or more.

[Comprehensive Evaluation]

Comprehensive evaluation was performed based on the following standards, including the evaluation results of preservation stability, fixation property and durability.

Excellent (Very favorable): All evaluation results are rated as "Good".

Good (Favorable): The evaluation results are rated as "Good" or "Not bad", of which there is one evaluation result rated as "Not bad".

Not bad (No problem with practical use): The evaluation results are rated as "Good" or "Not bad", of which there are two or three evaluation results rated as "Not bad".

Poor (No good): There is the evaluation result rated as "Poor".

The toners of Examples 1 to 19 and Comparative Examples 1 to 3 are shown in Table 1, and evaluation results for each toner is shown in Table 2.

TABLE 1

| | Dicarboxylic acid | | Diol | Polyester resin | | Toner | |
|---|---|---|---|---|---|---|---|
| | Carboxylic acid raw material | Input amount (kg) | Types (additive amount, kg) | Weight average molecular weight | Softening temperature (° C.) | Volume average particle size (μm) | CV (%) |
| Ex. 1 | Pimaric acid | 4.00 | 1,3-propanediol (0.57), BisphenolA (1.65) | 20000 | 120 | 7.0 | 25 |
| Ex. 2 | Isopimaric acid | 4.00 | 1,3-propanediol (0.57), BisphenolA (1.65) | 20500 | 120 | 6.9 | 26 |
| Ex. 3 | Sandaracopimaric acid | 4.00 | 1,3-propanediol (0.57), BisphenolA (1.65) | 19500 | 120 | 7.0 | 26 |
| Ex. 4 | Pimaric acid, Isopimaric acid, Sandaracopimaric acid | 4.00 | 1,3-propanediol (0.57), BisphenolA (1.65) | 20000 | 120 | 7.0 | 25 |
| Ex. 5 | Pimaric acid | 4.00 | 1,3-propanediol (0.71), BisphenolA (1.07) | 3000 | 115 | 7.1 | 25 |
| Ex. 6 | Pimaric acid | 4.00 | 1,3-propanediol (0.77), BisphenolA (0.83) | 2500 | 113 | 7.0 | 24 |
| Ex. 7 | Pimaric acid | 4.00 | 1,3-propanediol (0.27), BisphenolA (2.98) | 30000 | 125 | 6.9 | 24 |
| Ex. 8 | Pimaric acid | 4.00 | 1,3-propanediol (0.20), BisphenolA (3.30) | 30500 | 128 | 6.9 | 26 |
| Ex. 9 | Pimaric acid | 4.00 | 1,3-propanediol (0.86), BisphenolA (0.42) | 11000 | 110 | 7.1 | 25 |
| Ex. 10 | Pimaric acid | 4.00 | 1,3-propanediol (1.00) | 9000 | 107 | 7.0 | 25 |
| Ex. 11 | Pimaric acid | 4.00 | 1,3-propanediol (0.08), BisphenolA (3.78) | 24000 | 140 | 7.0 | 24 |
| Ex. 12 | Pimaric acid | 4.00 | 1,3-propanediol (0.04), BisphenolA (3.94) | 25500 | 143 | 6.8 | 26 |
| Ex. 13 | Pimaric acid | 4.00 | 1,4-butanediol (0.68) | 20000 | 120 | 7.1 | 26 |
| Ex. 14 | Pimaric acid, Isopimaric acid | 4.00 | 1,3-propanediol (0.57), BisphenolA (1.65) | 20000 | 120 | 6.9 | 25 |
| Ex. 15 | Pimaric acid, Sandaracopimaric acid | 4.00 | 1,3-propanediol (0.57), BisphenolA (1.65) | 20000 | 120 | 6.9 | 25 |
| Ex. 16 | Isopimaric acid, Sandaracopimaric acid | 4.00 | 1,3-propanediol (0.57), BisphenolA (1.65) | 20000 | 120 | 7.2 | 24 |
| Ex. 17 | Pimaric acid | 4.00 | 1,3-propanediol (0.57), BisphenolA (1.65) | 20000 | 120 | 7.0 | 25 |
| Ex. 18 | Pimaric acid | 4.00 | 1,3-propanediol (0.57), BisphenolA (1.65) | 20000 | 120 | 6.8 | 27 |
| Ex. 19 | Pimaric acid | 4.00 | 1,3-propanediol (0.57), BisphenolA (1.65) | 3000 | 105 | 6.9 | 25 |
| Comp. Ex. 1 | Pimaric acid | 4.00 (Monocarboxylic acid) | 1,3-propanediol (0.57), BisphenolA (1.65) | 3000 | 112 | 7.0 | 25 |
| Comp. Ex. 2 | Purified rosin | — | 1,2-propanediol (1.04), 1,3-propanediol (0.12), | 3500 | 115 | 7.0 | 25 |
| Comp. Ex. 3 | Abietic acid | 4.00 | 1,3-propanediol (0.57), BisphenolA (1.65) | 4500 | 113 | 7.0 | 25 |

TABLE 2

| | Preservation stability | | Fixation property | | | | |
|---|---|---|---|---|---|---|---|
| | Toner remaining amount (%) | Evaluation | Non-offset region (Lower limit temperature ° C./ Upper limit temperature ° C.) | Temperature width (° C.) | Evaluation | Durability Evaluation | Comprehensive evaluation |
| Ex. 1 | 0.2 | Good | 110/180 | 70 | Good | Good | Excellent |
| Ex. 2 | 0.1 | Good | 110/180 | 70 | Good | Good | Excellent |
| Ex. 3 | 0.3 | Good | 110/180 | 70 | Good | Good | Excellent |
| Ex. 4 | 0.5 | Good | 110/180 | 70 | Good | Good | Excellent |
| Ex. 5 | 0.9 | Good | 100/150 | 50 | Not bad | Good | Good |
| Ex. 6 | 1 | Not bad | 100/140 | 40 | Not bad | Good | Not bad |
| Ex. 7 | 0.1 | Good | 140/200 | 60 | Good | Good | Excellent |
| Ex. 8 | 0.4 | Good | 150/200 | 50 | Not bad | Good | Good |
| Ex. 9 | 1.3 | Not bad | 100/160 | 60 | Good | Not bad | Not bad |
| Ex. 10 | 1.2 | Not bad | 100/160 | 60 | Good | Not bad | Not bad |
| Ex. 11 | 0.5 | Good | 110/180 | 70 | Good | Good | Excellent |
| Ex. 12 | 2.5 | Not bad | 110/160 | 50 | Not bad | Good | Not bad |
| Ex. 13 | 0.8 | Good | 110/180 | 70 | Good | Good | Excellent |
| Ex. 14 | 0.2 | Good | 110/180 | 70 | Good | Good | Excellent |
| Ex. 15 | 0.3 | Good | 110/180 | 70 | Good | Good | Excellent |
| Ex. 16 | 0.2 | Good | 110/180 | 70 | Good | Good | Excellent |
| Ex. 17 | 0.6 | Good | 110/180 | 70 | Good | Good | Excellent |
| Ex. 18 | 0.8 | Good | 110/180 | 70 | Good | Good | Excellent |
| Ex. 19 | 2 | Not bad | 110/180 | 70 | Good | Good | Good |
| Comp. Ex. 1 | 2.3 | Not bad | 100/130 | 30 | Poor | Not bad | Poor |
| Comp. Ex. 2 | 5 | Poor | 110/140 | 30 | Poor | Poor | Poor |
| Comp. Ex. 3 | 2.5 | Not bad | 110/140 | 30 | Poor | Not bad | Poor |

Each of the toners of Examples 1 to 19 includes a polyester resin produced using dicarboxylic acid obtained from any compounds of pimaric acid, isopimaric acid and sandaracopimaric acid, thereby having no evaluation result rated as "Poor" in the evaluation results, and each of the toners was rated as practical as the comprehensive evaluation.

Each of the toners of Comparative Examples 1 to 3 had a problem of fixation property and was rated as "Poor" in the comprehensive evaluation. It is considered for the causes that in the toner of Comparative Example 1, a polyester resin was produced without using dicarboxylic acid and the polymerization degree of the polyester resin was thus insufficient, and also in the toners of Comparative Examples 2 and 3, reactivity of a plurality of carboxyl groups contained in carboxylic acid is different and the polymerization degree of the polyester resin was thus insufficient.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A method of manufacturing a toner, comprising:

a step of producing a polyester resin by a reaction of at least one dicarboxylic acid and at least one diol; and a step of producing a toner base particle comprising the polyester resin and a colorant, the at least one dicarboxylic acid being a biomass monomer which is a dicarboxylic acid formed from introduction of a carboxyl group into the end of a monocarboxylic acid selected from the group consisting of pimaric acid, isopimaric acid, and sandaracopimaric acid.

2. The method of claim 1, wherein weight average molecular weight of the polyester resin is 3000 or more and 30000 or less.

3. The method of claim 1, wherein a softening temperature of the polyester resin is 110° C. or higher and 140° C. or lower.

4. A method of manufacturing a toner, comprising:

a step of producing a polyester resin by a reaction of at least one dicarboxylic acid and at least one diol; and a step of producing a toner base particle comprising the polyester resin and a colorant, the at least one dicarboxylic acid being a biomass monomer which is a dicarboxylic acid formed from introduction of a carboxyl group into the end of a monocarboxylic acid selected from the group consisting of pimaric acid, isopimaric acid, and sandaracopimaric acid, said carboxyl group being introduced through an aldehyde compound generated by oxidizing a terminal alkene of the monocarboxylic acid with ozone gas.

5. The method of claim 4, wherein the biomass monomer is obtained by introducing the carboxyl group by oxidizing an aldehyde group of the aldehyde compound with sodium chlorite.

6. The method of claim 4, wherein weight average molecular weight of the polyester resin is 3000 or more and 30000 or less.

7. The method of claim 4, wherein a softening temperature of the polyester resin is 110° C. or higher and 140° C. or lower.

* * * * *